United States Patent [19]

Varan et al.

[11] Patent Number: 4,906,016

[45] Date of Patent: Mar. 6, 1990

[54] SKI WITH INCREASED TOE PINNING ABILITY

[76] Inventors: Cyrus O. Varan; Duane O. Varan, both of P.O. Box 4471, Albuquerque, N. Mex. 87196

[21] Appl. No.: 311,692

[22] Filed: Feb. 8, 1989

Related U.S. Application Data

[63] Continuation-in-part of Ser. No. 200,521, May 26, 1988, Pat. No. 4,826,201, which is a continuation-in-part of Ser. No. 78,902, Jul. 28, 1987, abandoned.

[51] Int. Cl.[4] ..... A63C 5/04

[52] U.S. Cl. ..... 280/608; 280/609

[58] Field of Search ..... 280/808, 809, 601, 11.12

[56] References Cited

U.S. PATENT DOCUMENTS

| | | | |
|---|---|---|---|
| 2,743,113 | 4/1956 | Griggs | 280/608 |
| 3,063,728 | 11/1962 | Patterson | 280/608 |
| 3,134,604 | 5/1964 | Aublinger | 280/608 |
| 3,687,469 | 8/1972 | Wada | 280/608 |
| 3,700,252 | 10/1972 | Schultes | 280/608 |
| 4,083,577 | 4/1978 | Ford | 280/608 X |
| 4,175,766 | 11/1979 | Barwin | 280/608 |
| 4,601,488 | 7/1986 | Jarrett | 280/608 X |

FOREIGN PATENT DOCUMENTS

| | | | |
|---|---|---|---|
| 324215 | 10/1957 | Switzerland | 280/609 |

*Primary Examiner*—Charles A. Marmor
*Assistant Examiner*—Michael Mar
*Attorney, Agent, or Firm*—Fleit, Jacobson, Cohn, Price, Holman & Stern

[57] ABSTRACT

A snow ski is provided including generally flat toe and heel sections and an arched center section extending between and interconnecting the toe and heel sections. The opposite side marginal edges of the bottom of the ski define snow biting edges for biting into an underlying snow surface when the ski is angularly displaced about its longitudinal axis relative to the snow surface and an intermediate length portion, only, of the snow biting edges extending along the heel section are modified to effectively reduce the capability thereof to bite into an underlying snow surface while the snow biting edges of the toe section of the ski are modified to increase the capability thereof to bite into the underlying snow surface. Further, the ski includes a predetermined toe binding area mounting location thereon spaced appreciably forward of the longitudinal mid-point of the ski, these features enabling elementary and intermediate level skiers to more readily "pin" the toe section of the ski when executing turns and allowing the heel section to controllably drift outward during the execution of a turn.

7 Claims, 1 Drawing Sheet

SKI WITH INCREASED TOE PINNING ABILITY

CROSS-REFERENCE TO RELATED APPLICATION

This application comprises a continuation-in-part of our co-pending U.S. Application Ser. No. 07/200,521 entitled SKI WITH INCREASED MANEUVERING ABILITY, filed May 26, 1988, now U.S. Pat. No. 4,826,201, which in turn is a continuation-in-part of our U.S. Application Ser. No. 07/078,902 entitled E-Z SKI, filed July 28, 1987, now abandoned.

BACKGROUND OF THE INVENTION

1. Field of the Invention

This invention relates to a ski designed to increase the profficiency of elementary and intermediate level skiers and to enable these level skiers to execute turns in various snow surface conditions with greater control and confidence. The ski design enables the invention to be carried out through the utilization of an attachment to a conventional ski and adapts a ski constructed in accordance with the present invention to function in various snow surface conditions and to decrease the running speed of the ski.

2. Description of Related Art

Various different forms of modified snow ski edges heretofore have been designed for various reasons, including those modified ski edges disclosed in U.S. Pat. Nos. 2,743,113, 3,134,604, 3,687,469, 3,700,252, 4,083,577 and 4,175,766, as well as Norwegian Pat. No. 55,063 and Swiss Pat. No. 39,116. However, these previously known forms of ski edges do not incorporate structure capable of performing the function of the ski edges of the instant invention.

SUMMARY OF THE INVENTION

The ski construction of the instant invention incorporates longitudinally spaced toe, center and heel sections with the toe and heel sections being generally flat and the center section being upwardly arched, the forward end of the toe section curving forwardly and upwardly into a terminal tip.

The ski construction includes an inverted channel-shaped attachment or member which is secured to a conventional ski in the toe area by means of suitable fasteners. The attachment or member includes structure to increase the capability of side edges to bite into the underlying snow surface when the ski is angularly displaced about its longitudinal axis for executing a turn.

In addition, the structure of attached member facilitates the skier's attempts to "pin" the toe section of the ski down harder upon the snow surface for making a turn.

Elementary and intermediate level skiers find it difficult to perform the toe pinning function required when using conventional skis and many of these level skiers experience excessive side slippage of their skis throughout the length thereof when attempting to execute turns.

In order to reduce the tendency for a snow ski to side slip throughout its length when being used by an elementary or intermediate level skier the performance of the ski equipped with attachment of the instant invention is improved when the toe binding area of the ski is shifted slightly forward of the usual longitudinal midpoint toe binding area. In addition, the longitudinal edge portions of the bottom of the ski in the heel section thereof includes edge structure, centrally intermediate the opposite ends of the heel section, which diminishes the ability of the edge structure to bite into an underlying snow surface between points spaced from the opposite ends of the heel section and the longitudinal side edge portions of the bottom of the ski, in the toe section thereof, include structure to increase the capability of those longitudinal side edge portions to bite into the underlying snow surface.

The above-mentioned structure is designed to modify opposite longitudinal edges of the bottom surface of the toe section of the ski, extending between points spaced from the front and rear ends of the toe section which comprise the major advance of the instant invention, resulting in a ski which is more readily maneuvered through turns by elementary and intermediate level skiers, with such skiers having greater control and confidence. In view of increasing the capability of the longitudinal edges in the toe area to bite into snow, the skis of the instant invention slow down to some degree when the skis are angularly displaced about their longitudinal axis (commonly known as edging).

The main object of this invention is to provide a snow ski which may be maneuvered through turns by elementary and intermediate level skiers with greater control and confidence.

Another object of this invention, in accordance with the immediately preceding object, is to provide a modified ski which may be more readily maneuvered through turns in various different snow surface conditions.

Still another object of this invention is to provide an improved snow ski which will enable elementary and intermediate level skiers to more readily "pin" the toe section of the ski while executing turns.

A further object of this invention is to provide beginning and intermediate skiers with skis which are slower and more sluggish than conventional skis.

A final object of this invention to be specifically enumerated herein is to provide an improved snow ski in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
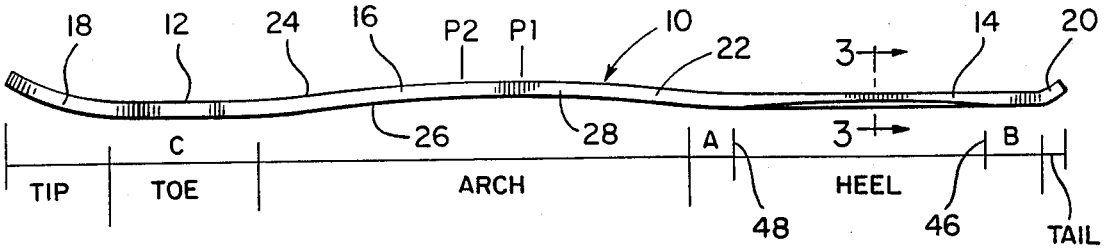
FIG. 1 is a side elevational view of a typical snow ski incorporating a first embodiment of the instant invention.
Figure 2:
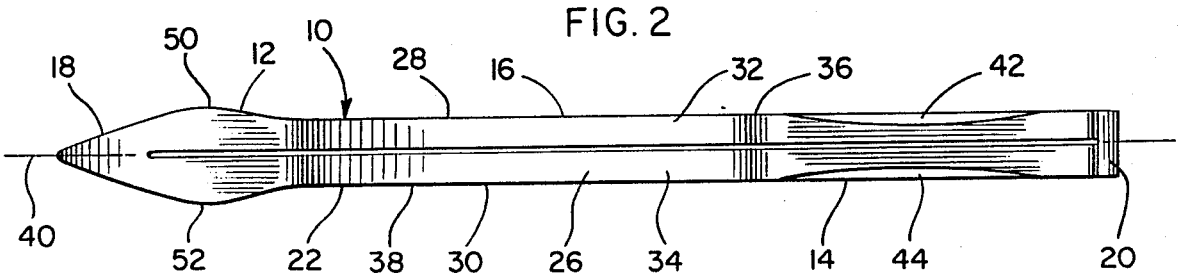
FIG. 2 is a bottom plan view of the snow ski illustrated in FIG. 1.
Figure 3:
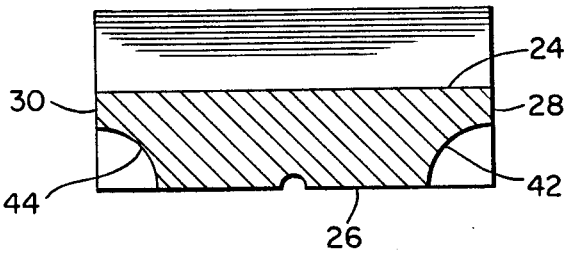
FIG. 3 is an enlarged transverse vertical sectional view taken substantially upon the plane indicated by the section line 3—3 of FIG. 1.

Referring now more specifically to the drawings, the numeral 10 generally designates a snow ski constructed in accordance with the present invention and incorporating a forward toe section 12, a rear heel section 14 and an arched center section 16 formed integrally with and extending between and connecting the toe and heel sections 12 and 14. The toe section 12 terminates forwardly in a forwardly and upwardly curving tip 18 which is forwardly transversely tapered and the heel section 14, terminates rearwardly in an upwardly directed tail 20, although the tail 20 may be omitted.

The ski 10 incorporates an elongated body 22 of which the sections 12, 14, 16, 18 and 20 comprise integral parts and the body 22 includes upper and lower surfaces 24 and 26 between which opposite side surfaces 28 and 30 extend.

The lower surface 26 is substantially longitudinally flat throughout the lengths of the toe section 12 and the heel section 14, but is arched throughout the center section 16. In addition, the lower surface includes opposite side longitudinal marginal portions 32 and 34 and the intersections of the marginal portions 32 and 34 and the side surfaces 28 and 30 define edge means 36 and 38 for biting into an underlying snow surface when the body 22 is angularly displaced about its longitudinal center axis 40 relative to an underlying snow surface. These edge means 36 and 38 function to limit side slippage of the ski 10 when executing turns and a proficient skier whose toe bindings are positioned at the location designated P1 in FIG. 1 leans forward when executing a turn in order to "pin" the inside edge means throughout the toe section 12 on the inside of the desired turn into the underlying snow surface. However, elementary and intermediate level skiers find it difficult to accomplish this toe pinning operation and in many cases are unable to execute the desired turn without excessive side slippage of the ski 10, or are just unable to execute the desired turn.

The ski 10, in order to better enable elementary and intermediate level skiers to execute turns, includes reduced snow surface biting means 42 and 44 along the edge means 36 and 38 in the heel section 14, only, and the reduced snow surface biting means 42 and 44 extend along the heel section 14 only between zones 46 and 48 of the heel section 14, thereby leaving the edge means 36 and 38 at the front and rear ends of the heel section 14 designated by the letters A and B unaltered. The reduced snow surface biting means 42 and 44 comprise relieved areas formed at the intersection of the lower surface 26 and the side surfaces 28 and 30, the relieved areas opening outwardly through both the lower surface 26 and the side surfaces 28 and 30, the relieved areas 42 and 44 therefore comprising "open" relieved areas.

When the ski 10 equipped with the relieved areas 42 and 44 is rotated about the longitudinal axis 40 so as to lift, for example, the relieved area 44 away from the underlying snow surface as when attempting to execute a turn to the left, the relieved area 42 extending between the zones 46 and 48 has a reduced capability to bite into the underlying snow surface, inasmuch as the zones A and B tend to maintain the relieved area 42 out of contact with the underlying snow surface. However, it is important to note that the relieved area 42 terminates forwardly and rearwardly rearward and forward, respectively, of the zones A and B. Thus, the longitudinally short and spaced apart zones A and B of the edge means 36 and 38 defined by the heel section 14 still perform their intended function of biting into the underlying snow surface during execution of a turn. However, since the overall biting action of the edge means 36 or 38 throughout the heel section 14 of the ski 10 is reduced, the heel section 14 may more readily slip, in a controlled manner, laterally in a direction away from the intended turn. Furthermore, the ski 10 is of somewhat shorter length than a conventional ski and the upper surface 24 defines a predetermined toe binding area P2 spaced appreciably forward of the longitudinal mid-point of the body 22 in which the toe binding area P1 is defined.

In addition to the forward shifting of the toe binding area P2 and the provision of the reduced snow surface biting means 42 and 44 extending along the heel section 14, the forward end portions of the edge means 36 and 38 are outwardly bowed as at 50 and 52 in the toe section 12 of the body 22. This, of course, increases the snow surface biting action of the forward ends of the edge means 36 and 38 carried by the toe section 12 and enables the slightly forwardly displaced elementary or intermediate skier to more readily "pin" the toe section 12 of the body 22 into the underlying snow surface when executing a turn.

Figure 5:
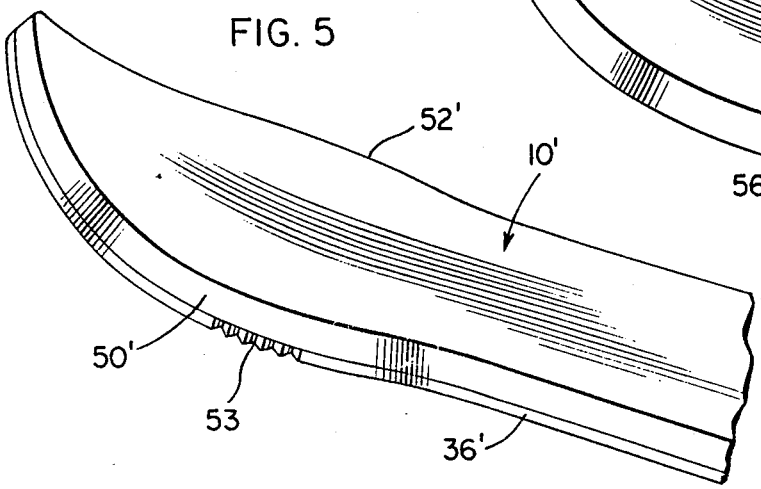
FIG. 5 is a fragmentary perspective view of the toe and tip sections of a ski illustrating a modified form of toe section.

With attention now invited more specifically to FIG. 5, it may be seen that the outwardly bowed portions 50' and 52' of the edge means 36' of a modified form of ski referred to in general by the reference numeral 10' include serrated edges 53 extending therealong, the ski 10' otherwise being substantially identical to the ski 10.

Figure 4:
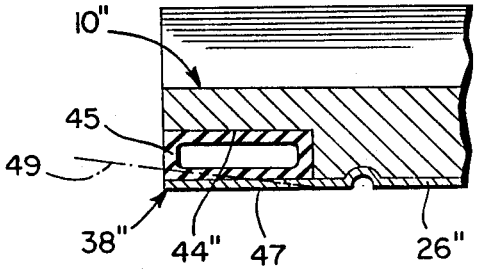
FIG. 4 is a fragmentary enlarged transverse vertical sectional view similar to FIG. 3, but illustrating a modified form of heel section.

With attention now invited more specifically to FIG. 4, a second modified form of ski is referred to in general by the reference numeral 10'' and includes rectangular cross sectional shape opposite side recesses corresponding to the recesses 42 and 44. Only one of the rectangular cross sectional recesses 44'' is illustrated in FIG. 4. The recess 44'' has a closed ended and opposite end tapering resilient tubular member 45 secured therein and the lower surface 26'' includes a stiff, but flexively resilient panel 47 secured thereunder. The panel 47 includes an outer marginal portion which underlies the tubular member 45. When the ski 10'' is used to execute a turn to the right, the additional downward loading on the edge means 38'' thereof corresponding to the edge means 38 is upwardly deflected to a position extending along the phantom line 49 in FIG. 4, the tubular member 45 also being deformed. Accordingly, the edge means 38'' has the snow surface biting capability thereof reduced in the zone of the heel section of the ski 10'' corresponding to that portion of the heel section 14 extending between the zones 46 and 48 of the ski 10.

Figure 6:
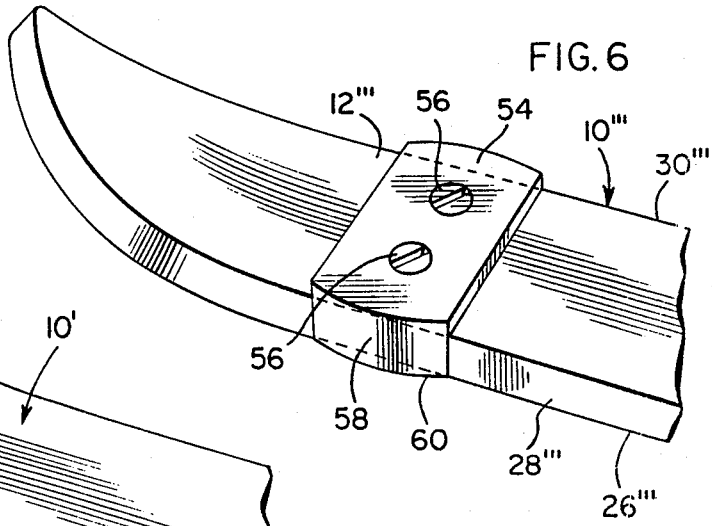
FIG. 6 is a fragmentary perspective view similar to FIG. 5 and illustrating the manner in which the toe section of a conventional ski may be modified in accordance with the present invention.

With reference now to FIG. 6, a further form of ski is referred to in general by the reference numeral 10''' and includes a conventional straight sided toe section 12''' over which an inverted channel shaped member 54 has been secured through the utilization of suitable fasteners 56, the channel member 54 including opposite side portions which extend downwardly over the edge sides 28''' and 30''' of the ski 10''' and include outer side surfaces 58 which are outwardly bowed and include lower extremities 60 which are substantially flush with the lower surface 26''' of the ski 10'''. Thus, the lower extremities 60 serve the same purpose as the outwardly bowed portions 50 and 52 of the toe section 12 defined on the body 22 of the ski 10.

Thus, FIG. 4 represents a modification of the reduced snow surface biting means 42 and 44 of the ski 10 and FIGS. 5 and 6 illustrate modifications of the outwardly bowed portions 50 and 52 of the toe section 12 incorporated on the body 22.

Although it was originally felt that the primary function of the bowed portions 50, 52 and 50', 52' as well as the lower extremities 60 was to augment the action of the recesses 42, 44 and the recesses 44'' in conjunction with the deflectable underlying portions of panel 42, it has been found that the bowed portions 50, 52 and 50', 52' as well as the lower extremities 60 of the inverted channel shaped member 52 are operative, independently of the above-noted recesses, to greatly increase the ability of a novice skier to "pin" the toes of his or skis when executing a turn. Further, the toe section features of the ski also function to slow down skis for the benefit of beginners.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A snow ski designed to increase the proficiency of elementary and intermediate level skiers and to enable these levels of skiers to execute turns in various snow surface conditions with greater control and confidence and to also function to create a drag on the associated snow surface for retarding the speed of said ski, said ski including an elongated body defining a center longitudinal axis and incorporating an elongated and longitudinally extending forward toe section having a substantially flat lower surface, an elongated and longitudinally extending heel section having a substantially flat lower surface, an elongated and longitudinally extending arched center section extending between and interconnecting said toe and heel sections and an upwardly curving tip extending forward from the forward end of said toe section, said body including generally parallel upper and lower surfaces interconnected by opposite side surfaces extending therebetween, said opposite side surfaces being generally parallel throughout at least said center and heel sections, said side surfaces and said lower surfaces, at their respective points of intersection, forming opposite edges for biting into and underlying snow surface, by one of said edges, when said body is angularly displaced about its center longitudinal axis thereby raising the opposite edge relative to said snow surface, at least one of said side surfaces and the corresponding edge, in said toe section only, being outwardly bowed with the outwardly bowed portion, only, of said edge being serrated and with the serrations thereof flush with said bowed portion of said one side surface, said bowed portion of said one side surface and said serrated edge defining increased snow surface biting means effective to increase the capacity of the bowed portion of said one edge to bite into said snow surface over the capability of the remaining portion of said one opposite edge of said body to bite into said snow surface.

2. The snow ski of claim 1 wherein said heel section has a center portion and opposite end portions, said heel section having said opposite edges formed therein, at least said one opposite edge, in the heel section center portion only, having a recessed area formed therein adjacent the corresponding side surface, said recessed area extending into the corresponding side surface and the corresponding lower surface, thereby reducing the effective snow biting capacity of said heel center section portion of said one edge when predetermined downward and lateral forces are exerted thereon.

3. The snow ski of claim 2 wherein a resilient body is secured in said recessed are, said lower surface including a stiff, but flexively resilient panel secured thereunder an underlying said recessed area, said resilient body comprising a resilient backing for the portion of said panel disposed under said resilient body, said portion of said panel and said resilient body, together, having the ability to yield upwardly upon predetermined downward and lateral forces exerted on said heel section center portion of said one edge being exceeded.

4. The snow ski of claim 1 wherein said upper surface defines a predetermined toe binding mounting area thereon spaced appreciably forward of the longitudinal mid-portion of said body.

5. A snow ski designed to increase the proficiency of elementary and intermediate level skiers and to enable these levels of skiers to execute turns in various snow surface conditions with greater control and confidence and to also function to create a drag on the associated snow surface for retarding the speed of said ski, said ski including an elongated body defining a center longitudinal axis and incorporating an elongated and longitudinally extending forward tow section having a substantially flat lower surface, and elongated and longitudinally extending heel section having a substantially flat lower surface, an elongated and longitudinally extending arched center section extending between and interconnecting said toe and heel sections and an upwardly curving tip extending forward from the forward end of said toe section, said body including generally parallel upper and lower surfaces interconnected by opposite side surfaces extending therebetween, said opposite side surfaces being generally parallel throughout at least said center and heel sections, said side surfaces and said lower surfaces, at their respective points of intersection, forming opposite edges for biting into and underlying snow surface, by one of said edges, when said body is angularly displaced about its center longitudinal axis thereby raising the opposite edge relative to said snow surface, said toe sections, only, including an attachment secured over said toe section from thereabove and including a depending portion extending downwardly over said one side surface of said toe section and terminating downwardly substantially flush with the portion of said lower surface extending along said toe section, said depending portion defining a single outwardly bowed portion of said one edge in said toe section only functioning as increased snow surface biting means effective to increase the capacity of the corresponding side of said toe section to bite into said snow surface over the capability of the remaining one of said edges to bite into said snow surface.

6. The snow ski of claim 5 wherein said heel section has a center portion and opposite end portions, said heel section having said opposite edges formed therein, at least said one opposite edge, in the heel section center portion only, having a recessed area formed therein adjacent the corresponding side surface, said recessed area extending into the corresponding side surface and the corresponding lower surface, thereby reducing the effective snow biting capacity of said heel center section portion of said one edge when predetermined downward and lateral forces are exerted thereon.

7. The snow ski of claim 6 wherein a resilient body is secured in said recessed area, said lower surface including a stiff, but flexively resilient panel secured thereunder an underlying said recessed area, said resilient body comprising a resilient backing for the portion of said panel disposed under said resilient body, said portion of said panel and said resilient body, together, having the ability to yield upwardly upon predetermined downward and lateral forces exerted on said heel section center portion of said one edge being exceeded.

* * * * *